US011358760B2

(12) United States Patent
McNamara et al.

(10) Patent No.: US 11,358,760 B2
(45) Date of Patent: Jun. 14, 2022

(54) STRAW LID ASSEMBLY

(71) Applicant: Helen of Troy Limited, St. Michael (BB)

(72) Inventors: Conor McNamara, Montclair, NJ (US); Benjamin Robert Hein, Bend, OR (US); Jeffrey T. Burga, Bend, OR (US); Jarett Volkoff, Bend, OR (US)

(73) Assignee: Helen of Troy Limited, St. Michael (BB)

( * ) Notice: Subject to any disclaimer, the term of this patent is extended or adjusted under 35 U.S.C. 154(b) by 17 days.

(21) Appl. No.: 16/565,569

(22) Filed: Sep. 10, 2019

(65) Prior Publication Data

US 2021/0070508 A1 Mar. 11, 2021

(51) Int. Cl.
*A47G 19/22* (2006.01)
*B65D 47/06* (2006.01)
(Continued)

(52) U.S. Cl.
CPC ..... *B65D 47/065* (2013.01); *B65D 43/0231* (2013.01); *B65D 47/20* (2013.01);
(Continued)

(58) Field of Classification Search
CPC ..... A47G 19/2266; A47G 19/2272; A47G 19/22; A47G 19/2222; A47G 21/185; A47G 21/18; B65D 43/16; B65D 43/0231; B65D 47/305; B65D 47/065; B65D 47/32; B65D 47/24; B65D 47/20; B65D 53/02; B65D 2543/00046; B65D 47/06; B65D 47/066; B65D 2547/063; B65D 47/30;
(Continued)

(56) References Cited

U.S. PATENT DOCUMENTS 1,747,550 A * 2/1930 Klimburg ..... B65D 47/30 222/507
2,030,696 A 2/1936 Forster
(Continued)

FOREIGN PATENT DOCUMENTS

GB 2293818 4/1996
WO 2009-123661 10/2009

OTHER PUBLICATIONS

International Search Report filed in PCT/US2020/049313 dated Dec. 9, 2020.

*Primary Examiner* — Gideon R Weinerth
(74) *Attorney, Agent, or Firm* — Rankin, Hill & Clark LLP

(57) ABSTRACT

A straw lid valve assembly includes a cap, a spout, and a valve member. The cap connects with a drinking vessel and includes valve receiving passage. The spout connects with the cap and pivots between a drinking position and a closed position. The spout includes an inner passage that is in fluid communication with the drinking vessel when in the drinking position and is closed off when in the closed position. The valve member is receivable in the cap and includes a drink passage and a vent passage in fluid communication with the drinking vessel when the cap is connected with the drinking vessel and the valve member is received in the cap. The valve member is receivable in the valve receiving passage such that an uppermost surface of the valve member is exposed to ambient when the spout is in the drinking position and the valve member is received in the cap.

15 Claims, 9 Drawing Sheets

(51) Int. Cl.

| | |
|---|---|
| ***B65D 47/30*** | (2006.01) |
| ***B67D 3/00*** | (2006.01) |
| ***B65D 47/20*** | (2006.01) |
| ***B65D 43/02*** | (2006.01) |
| ***B65D 47/32*** | (2006.01) |

(52) U.S. Cl.
CPC ..... *B65D 47/32* (2013.01); *A47G 19/2266* (2013.01); *A47G 19/2272* (2013.01); *B65D 47/305* (2013.01)

(58) Field of Classification Search
CPC ..... A47J 41/0027; A45F 3/18; Y10S 215/902; Y10S 220/19; Y10S 285/901
USPC ..... 220/531, 536, 484, 494, 705, 708, 373, 220/367.1; 222/254.4, 534, 484, 517, 222/536; 215/387, 388, 389, 229, 312, 215/902
See application file for complete search history.

(56) References Cited

U.S. PATENT DOCUMENTS 2,032,776 A 3/1936 Van Ness
2,134,119 A 10/1938 Franz
2,717,726 A * 9/1955 Mart ..... B65D 47/305 222/498
2,800,259 A 7/1957 Wilson
2,883,091 A 4/1959 Barravecchia
2,936,934 A * 5/1960 Kubiliunas ..... B65D 47/305 222/484
2,971,664 A * 2/1961 Jacob ..... B65D 47/305 222/536
2,979,238 A * 4/1961 Bramming ..... A47G 21/18 222/484
3,023,939 A * 3/1962 Gustafson ..... B65D 47/305 222/536
3,036,600 A 5/1963 Vickery
3,089,626 A * 5/1963 Kubiliunas ..... B65D 47/305 222/484
3,163,337 A 12/1964 Sardam
3,265,256 A 8/1966 Chaber
3,283,967 A * 11/1966 Akers ..... B65D 47/305 222/536
3,490,659 A 1/1970 Vange
3,502,248 A * 3/1970 Newby ..... B65D 47/305 222/536
3,568,895 A 3/1971 Porter
3,751,787 A 8/1973 Porter
3,961,770 A 6/1976 Wrasman
4,209,115 A 6/1980 Stahl
4,219,138 A 8/1980 Hazard
4,519,529 A 5/1985 Seltz
4,595,123 A * 6/1986 Libit ..... B65D 55/02 285/391
4,903,870 A 2/1990 La Vange
5,065,909 A * 11/1991 Pino ..... B65D 47/305 222/484
5,242,079 A * 9/1993 Stephens ..... A47G 19/2266 215/229
5,477,994 A * 12/1995 Feer ..... B65D 47/305 137/846
5,615,809 A * 4/1997 Feer ..... B65D 47/305 222/484
5,797,521 A * 8/1998 Sobral ..... B65D 47/305 222/484
5,873,478 A * 2/1999 Sullivan ..... A47G 19/2266 215/389
5,904,337 A 5/1999 VanKirk et al.
5,908,126 A * 6/1999 Wang ..... B65D 47/305 215/229
6,032,813 A 3/2000 Niermann
6,793,104 B2 * 9/2004 Kao ..... B65D 39/0052 222/481.5
7,165,549 B2 * 1/2007 Philipps ..... A61H 35/04 128/207.16
7,988,013 B2 8/2011 Lin
8,668,106 B1 * 3/2014 Joy ..... B65D 47/305 220/254.3
9,061,813 B2 6/2015 Steininger
9,149,808 B1 10/2015 Smith et al.
9,573,738 B1 * 2/2017 Lai ..... B65D 47/305
9,879,789 B2 1/2018 Webb
D812,966 S * 3/2018 Murosky ..... D7/392.1
11,097,875 B2 * 8/2021 Starner ..... B65D 47/305
11,214,399 B1 * 1/2022 Hoppe ..... B65D 1/04
2003/0111493 A1 * 6/2003 Kao ..... B65D 39/0052 222/481.5
2005/0150916 A1 * 7/2005 De Laforcade ..... B65D 47/305 222/534
2006/0186076 A1 * 8/2006 Shiloni ..... B65D 51/1644 215/229
2006/0226110 A1 * 10/2006 Choi ..... A45F 3/20 215/228
2009/0120946 A1 * 5/2009 Hung ..... A47G 19/2266 220/707
2012/0181277 A1 * 7/2012 Wang-Wu ..... B65D 47/305 220/212
2012/0181303 A1 * 7/2012 Swanick ..... B65D 47/32 222/83
2012/0305559 A1 * 12/2012 Steininger ..... B65D 51/1672 220/253
2015/0257558 A1 * 9/2015 May ..... A47G 19/2272 220/669
2017/0208974 A1 * 7/2017 Zhang ..... B65D 47/0857
2018/0332987 A1 * 11/2018 Lin ..... B65D 51/18
2019/0263572 A1 * 8/2019 Keung ..... A47G 19/2266
2021/0147125 A1 * 5/2021 McNamara ..... B65D 51/1622

* cited by examiner

STRAW LID ASSEMBLY

BACKGROUND

Drinking vessels that include straw lid caps often include a spout that pivots with respect to the cap. Traditionally, seals on these straw lids are typically an O-ring gasket that is compressed between a ball at one end of the spout and a cap to create a seal when the spout is in the closed position. These seals are prone to leaking when this compression is insufficient. Additionally, the O-ring can wear over time causing a leak.

U.S. Pat. No. 3,568,895 discloses a dispensing closure cap having a pivoting spout cooperating with an insert; however, the dispensing closure cap lacks a vent and is not described as cooperating with a straw. The insert includes a main disc body formed with a semispherical socket formation in which an outlet hole is provided. The spout includes a spherical base portion from which extends an arm portion. An outlet passageway extends through the base portion and the arm portion. The outlet hole of the insert is sealed by a plug that is attached at its lower end inside a recess provided in the base of the spout.

SUMMARY

In view of the foregoing, a straw lid valve assembly includes a cap, a spout, and a valve member. The cap is configured to connect with a drinking vessel, and includes valve receiving passage. The spout connects with the cap and pivots about a pivot axis between a drinking position and a closed position. The spout includes an inner passage that is in fluid communication with the drinking vessel when in the drinking position and is closed off from the drinking vessel when in the closed position. The valve member is receivable in the cap. The valve member includes a drink passage and a vent passage both of which are in fluid communication with the drinking vessel when the cap is connected with the drinking vessel and the valve member is received in an operative position in the cap. The valve member is receivable in the valve receiving passage such that an uppermost surface of the valve member is exposed to ambient when the spout is in the drinking position and the valve member is received in the operative position in the cap.

DETAILED DESCRIPTION

Figure 1:
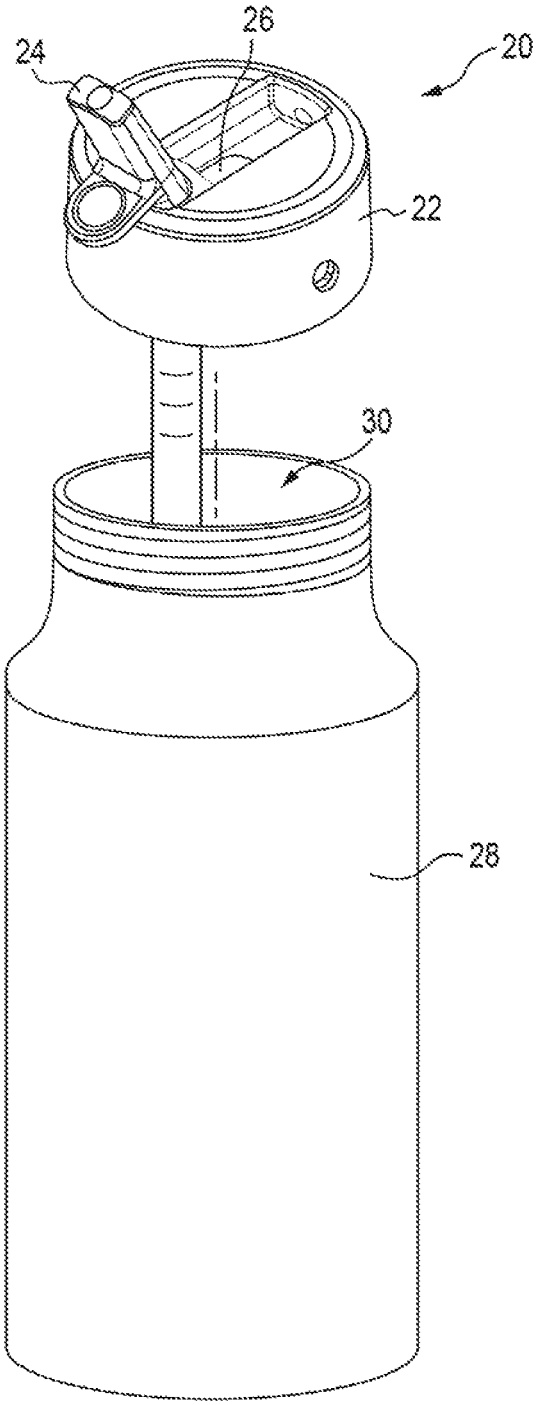
FIG. 1 is a perspective view of a straw lid cap assembly removed from a drinking vessel.

FIG. 1 depicts a straw lid valve assembly 20 including a cap 22, a spout 24, and a valve member 26. The cap 22 is configured to connect with a drinking vessel 28 to close an upper opening 30 of the drinking vessel 28. The spout 24 pivotally connects with the cap 22. The spout 24 is pivotal between a drinking position shown in FIG. 1 and a closed position shown in FIG. 2. The valve member 26 is receivable in the cap 22 so as to cooperate with the spout 24 to provide selective fluid communication between the drinking vessel 28 and ambient through the spout 24 and the valve member 26.

Figure 3:
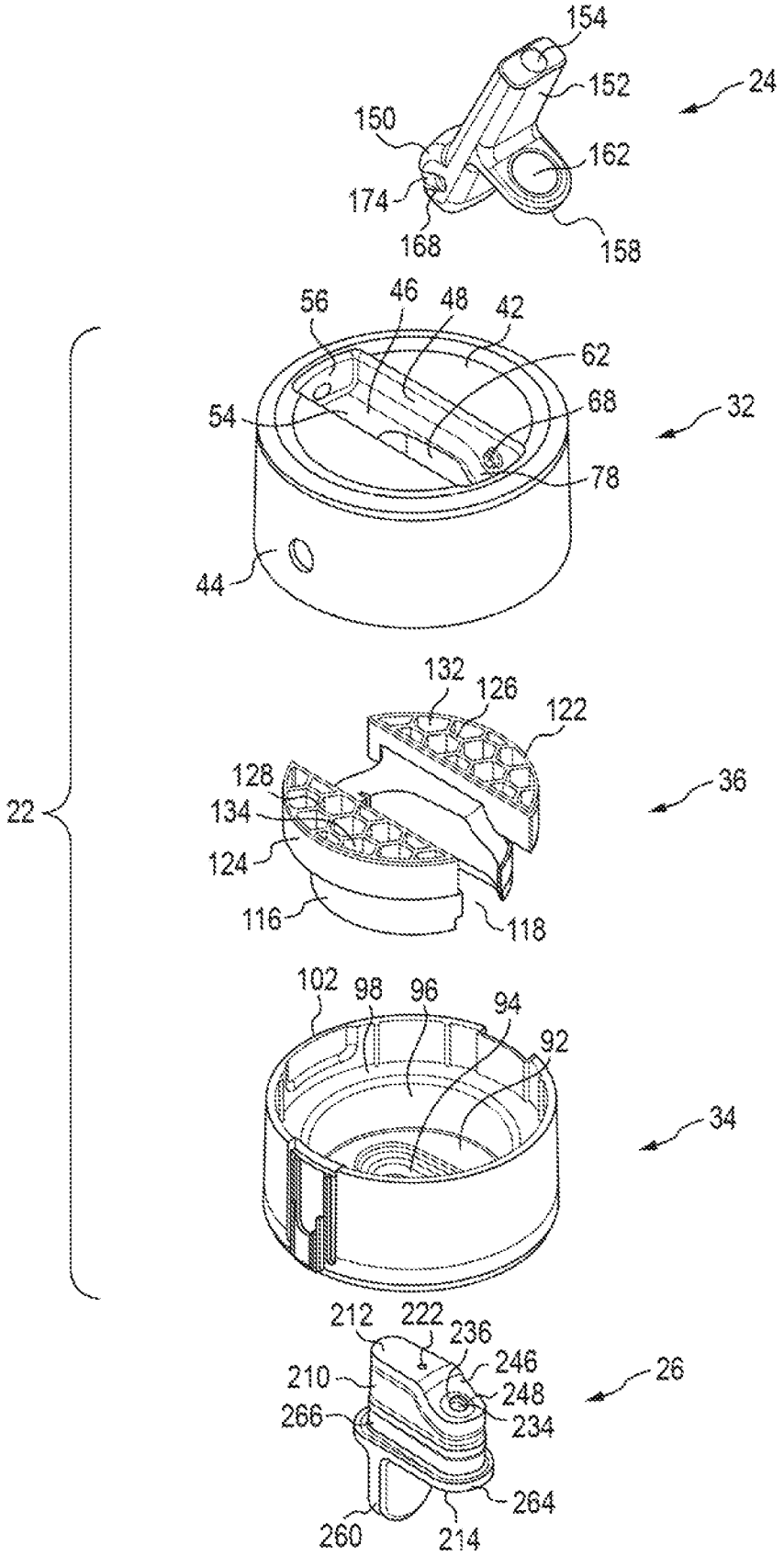
FIG. 3 is an exploded view of the straw lid cap assembly shown in FIG. 1.
Figure 4:
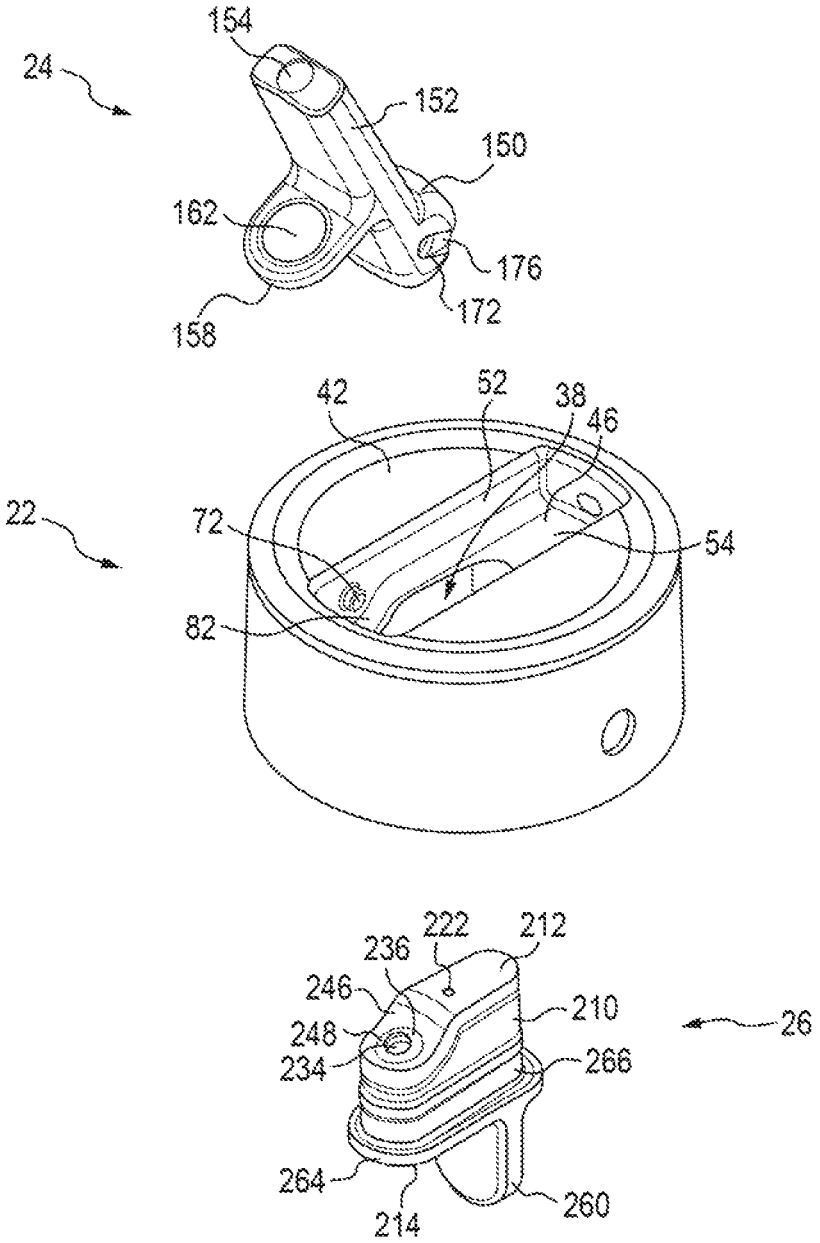
FIG. 4 is a disassembled view of the straw lid cap assembly shown in FIG.

With reference to FIG. 3, in the illustrated embodiment, the cap 22 is an assembly including a top cap 32, a bottom cap 34, and an insulation insert 36. When assembled, the top cap 32 connects with the bottom cap 34 with the insulation insert 36 disposed between the top cap 32 and the bottom cap 34. When assembled, the cap 22 includes a valve receiving passage 38 (FIG. 4) configured to selectively receive the valve member 26. FIG. 4 depicts the straw lid valve assembly 20 disassembled in a manner that can be accomplished by a person to clean the straw lid valve assembly 20. FIG. 3 depicts the cap 22 in an exploded view, however, after the cap 22 is finally assembled, e.g., in a manufacturing facility, the cap 22 is not intended to be disassembled in the manner shown in FIG. 3.

With reference back to FIG. 3, the top cap 32 includes an upper wall 42 that is circular in plan view in the illustrated embodiment. An outer side wall 44, which is cylindrical in the illustrated embodiment, depends downwardly from a periphery of the upper wall 42. The top cap 32 further includes a spout receiving recess 46 that is rectangular in plan view in the illustrated embodiment. The spout receiving recess 46 is defined by opposing recess side walls 48, 52 which depend vertically downward from the upper wall 42. The spout receiving recess 46 is also defined by a recess floor 54, which is planar and horizontally oriented in the illustrated embodiment. The spout receiving recess 46 also includes a distal end wall 56 and a proximal end wall 58 (FIG. 5), both of which depend downwardly from the upper wall 42. The top cap 32 also includes a downwardly depending valve receiving wall 62 which defines the valve receiving passage 38.

The spout 24 and the cap 22 include cooperating axle features to pivotally connect the spout 24 with the cap 22. In the illustrated embodiment, the top cap 32 includes axles 68, 72 each extending inwardly from a respective opposing recess side wall 48, 52. The axles 68, 72 define a pivot axis 74 (FIG. 5) about which the spout 24 pivots with respect to the cap 22. The top cap 32 further includes concave surfaces 78, 82 disposed on opposite sides of the valve receiving passage 38 when the cap 22 is assembled. The concave surfaces 78, 82 substantially follow a radius emanating from the pivot axis 74.

Figure 5:
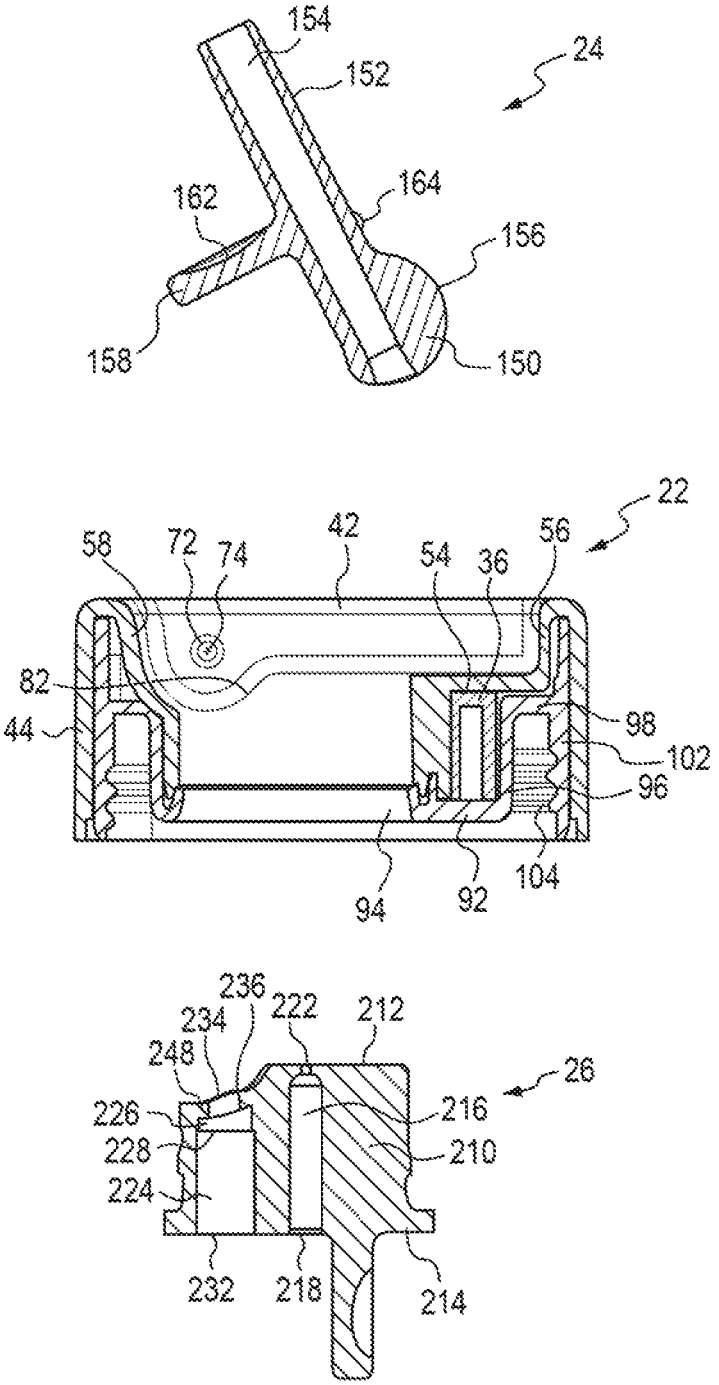
FIG. 5 is an exploded cross-sectional view of the straw lid cap assembly shown in FIG. 1.

The bottom cap 34 includes a lower wall 92 that is circular in plan view in the illustrated embodiment. The lower wall 92 includes a valve receiving opening 94 that defines a portion of the valve receiving passage 38. An inner wall 96 extends upwardly from the lower wall 92. The bottom cap 34 also includes an upper wall 98 extending radially outward from the inner wall 96. The bottom cap 34 also includes an outer wall 102, which is cylindrical in the illustrated embodiment, extending upwardly and downwardly from the upper wall 98. With reference to FIG. 5, internal threads 104 are provided on the outer wall 102 beneath the upper wall 98 to facilitate connecting the cap 22 to the drinking vessel 28 (FIG. 1). The outer wall 102 of the bottom cap 34 is received within the outer side wall 44 of the top cap 32 when the cap 22 is assembled.

With reference back to FIG. 3, the insulation insert 36 includes a U-shaped lower body section 116. The U-shaped lower body section 116 includes a recess 118 corresponding with the valve receiving passage 38 when the cap 22 is finally assembled. The insulation insert 36 also includes opposing segments 122, 124 on opposite sides of the recess 118. Each opposing segment 122, 124 includes respective internal walls 126, 128 defining respective elongate voids 132, 134.

Figure 2:
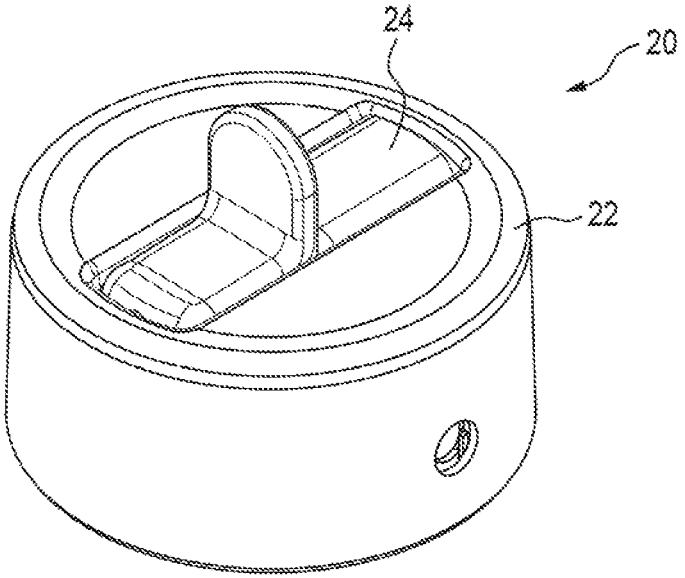
FIG. 2 is another perspective view of the straw lid cap assembly with a spout in a closed position.
Figure 6:
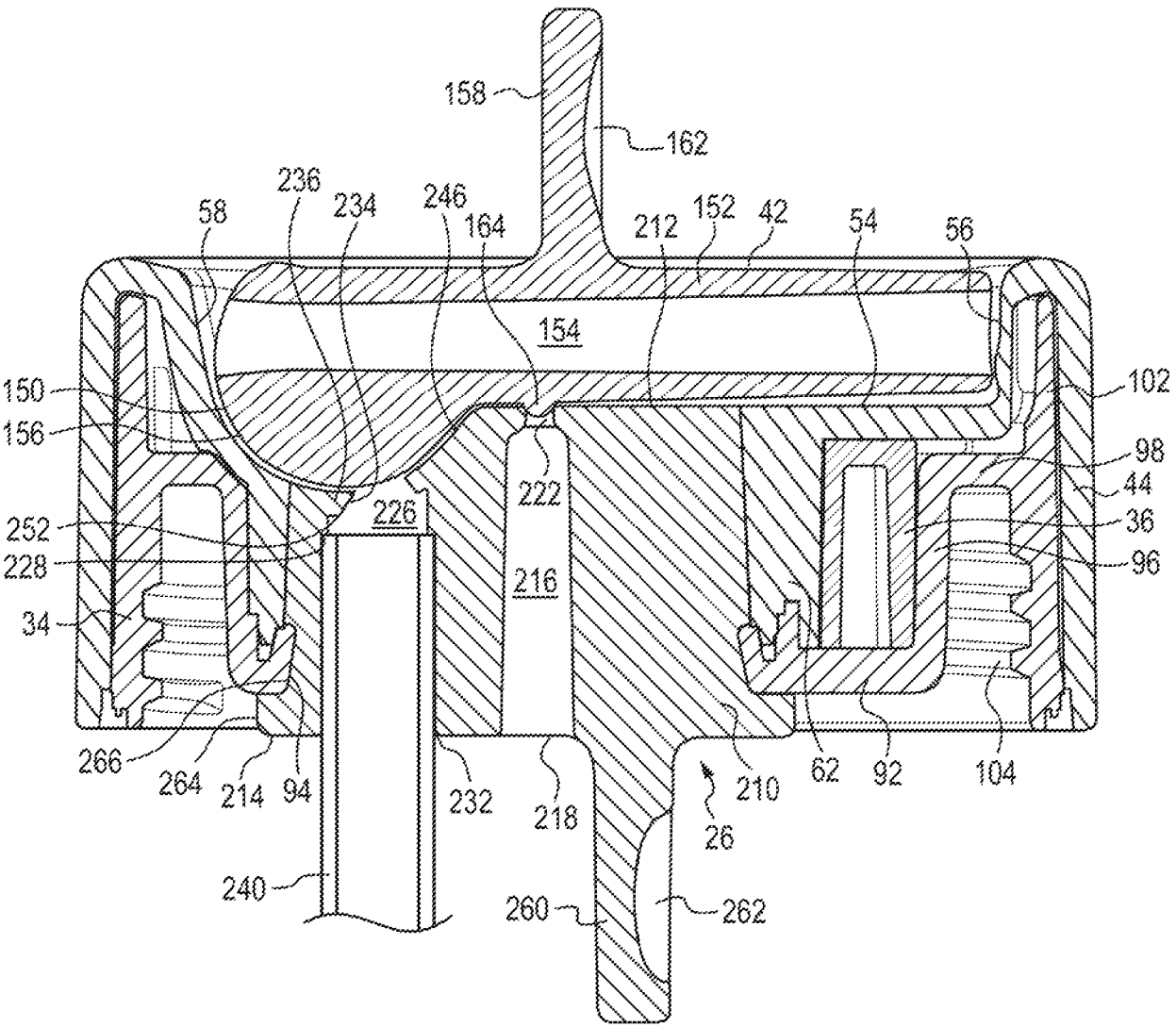
FIG. 6 is a cross-sectional view of the straw lid cap assembly shown in FIG. 1 with the spout in the closed position.

The spout 24 includes a base 150 and an extension 152 extending from the base 150. An inner passage 154 extends through the base 150 and the extension 152. The inner passage 154 is in fluid communication with the drinking vessel 28 when the spout 24 is in the drinking position (FIG. 1) and is closed off from the drinking vessel 28 when the spout 24 is in the closed position (FIGS. 2 and 6).

The base 150 is rounded in the illustrated embodiment. The base 150 includes a convex outer surface 156. When the spout 24 is connected with the cap 22, the convex outer surface 156 follows the radius emanating from the pivot axis 74 about which the spout 24 pivots with respect to the cap 22.

The extension 152 extends from the base 150. A flange 158 extends away from the extension 152 in a direction generally perpendicular to the longest dimension of the inner passage 154. A finger recess 162 is provided in the flange 158 to receive a finger or thumb to facilitate pivotal movement of the spout 24 with respect to the cap 22. A bump 164 also extends from the extension 152 in a direction generally opposite that to which the flange 158 extends from the extension 152. The bump 164 operates as a vent closure when the spout 24 is in the closed position (see FIG. 6).

As mentioned above, the spout 24 and the cap 22 include cooperating axle features to pivotally connect the spout 24 with the cap 22. The axle features include the axles 68, 72 and circular recesses 168, 172, which in the illustrated embodiment are provided in the base 150 of the spout 24. Each axle 68, 72 is received within a respective circular recess 168, 172, which allows the spout 24 to pivot with respect to the cap 22. In the illustrated embodiment, the spout 24 further includes channels 174, 176. Each channel 174, 176 emanates from a respective circular recess 168, 172. Each channel 174, 176 has a width that is slightly larger than a diameter of the respective axle 68, 72 and approximately equal to a diameter of the circular recess 168, 172 from which it emanates. Each axle 68, 72 is receivable in a respective channel 174, 176 to allow for selective removal of the spout 24 from the cap 22 when pulled in a direction parallel with the length of each channel 174, 176.

Figure 7:
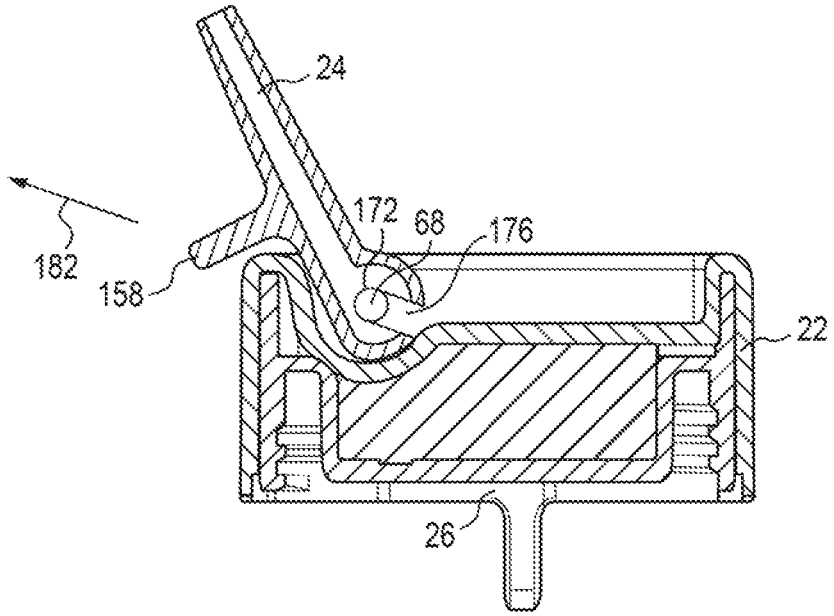
FIG. 7 is a cross-sectional view of the straw lid cap assembly shown in FIG. 1 with the spout in a drinking position showing cooperating axle features to pivotally connect the spout with a cap.
Figure 8:
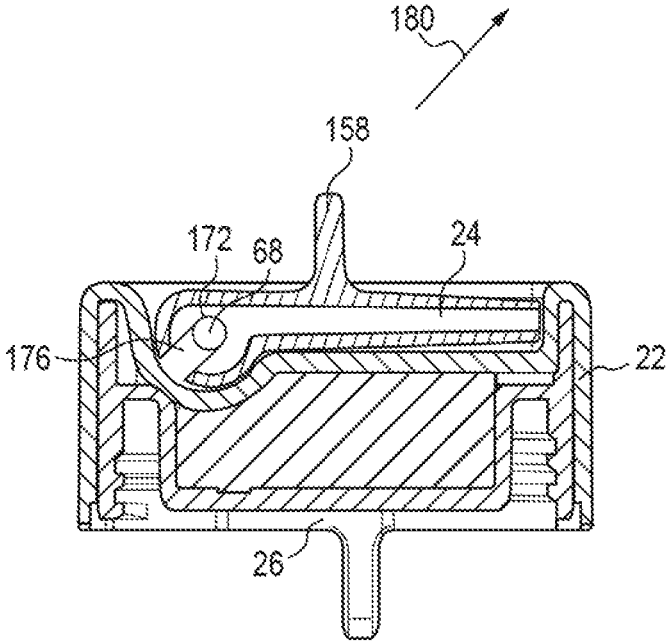
FIG. 8 is a cross-sectional view of the straw lid cap assembly shown in FIG. 1 with the spout in the closed position showing cooperating axle features to pivotally connect the spout with the cap.

Each of the channels 174, 176 is oriented such that removal of the spout 24 from the cap 22 is precluded when the spout 24 is in the drinking position. As seen when comparing FIG. 7 to FIG. 8, when the spout 24 is in the closed position (FIG. 8) a user can grasp the flange 158 and pull the spout 24 with respect to the cap 22 in a direction (arrow 180) aligned with the length (longest dimension) of each channel 174, 176. In doing so, the axles 68, 72 are pulled from the circular recess 168, 172 and enter the channels 174, 176 until the spout 24 is removed from the cap 22. In contrast, as seen in FIG. 7 with the spout 24 in the drinking position, each channel 174, 176 is oriented such that pulling the spout 24 with respect to the cap 22 in the direction (arrow 182) aligned with the length of each channel 174, 176 is precluded because the spout 24 is in contact with the cap 22, which precludes removal in that direction. With the spout 24 removed from the cap 22, the axles 68, 72 can be aligned with the channels 174, 176 and the spout 24 can be pushed toward the cap 22 in a direction aligned with the length of each channel 174, 176 until the axles 68, 72 are received in the circular recesses 168, 172.

The axle features shown in the illustrated embodiment can be reversed in that axles similar to the axles 68, 72 can be provided on the spout 24 and the circular recesses and channels can be provided on the cap 22.

Both the cap 22 and the spout 24 can be made from relatively more rigid plastics as compared to the plastic from which the valve member 26 is made. In the illustrated embodiment, the valve member 26 is made from a resilient material, such as silicone. The valve member 26 includes a main valve body 210 which is an integrally formed solid piece of silicone. The main valve body 210 fills the valve receiving passage 38 and seals against an inner side of the valve receiving passage 38. The valve receiving passage 38 extends through the cap 22 from the lower wall 92 to the recess floor 54 of the spout receiving recess 46. The allows for a large opening in the cap 22, which can be more easily cleaned, as compared to straw lid cap assemblies in which the straw connects with a more permanent feature on the cap.

The valve member 26 includes an uppermost surface 212, which is planar in the illustrated embodiment. The valve member 26 also includes a lower surface 214, which is also planar in the illustrated embodiment. A vent passage 216 extends from a lower vent opening 218 provided in the lower surface 214 to an upper vent opening 222 provided in the uppermost surface 212. As shown in FIG. 6, the upper vent opening 222 is closed by the bump 164 when the spout 24 is in the closed position. The vent passage 216 is open to ambient when the spout 24 is in the drinking position.

A drink passage, which includes a lower passage 224 and an upper passage 226 extends through the main valve body 210. The drink passage includes a shoulder 228 between the lower passage 224 and the upper passage 226, which has a diameter less than the lower passage 224. The lower passage 224 begins at a lower drink opening 232 provided in the lower surface 214. The drink passage also includes an upper drink opening 234 that is surrounded by a flexible sealing ring 236, which will be described in more detail below. The shoulder 228 is axially offset from the flexible sealing ring 236, which allows the flexible sealing ring 236 to flex toward the shoulder 228 to provide an adequate seal to prevent liquid from leaking from the straw lid valve assembly 20. The lower passage 224 is configured to receive a straw 240 within the lower passage 224. The straw 240 is inserted so as to contact the shoulder 228 and the flexible sealing ring 236 is offset axially above the top end of the straw 240 when the straw 240 is inserted, which allows for desirable movement of the flexible sealing ring 236.

Figure 9:
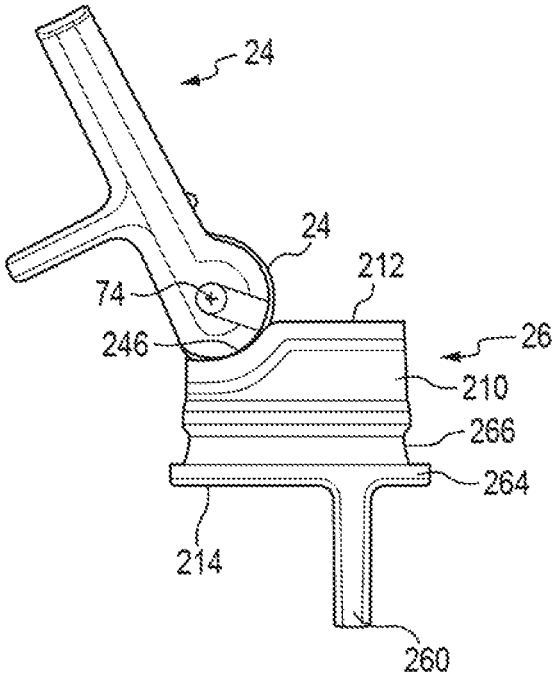
FIG. 9 is a side view of the spout and a valve member of the straw lid cap assembly with the valve member in an operative position and the spout in the drinking position.

The valve member 26 is received in the valve receiving passage 38 of the cap 22 so as to be in an operative position (shown in FIGS. 1, 6 and 9) in which the valve member 26 can cooperate with the spout 24 to provide for selective communication between the inner passage 154 of the spout 24 and the straw 240. The valve member 26 includes a concave bearing surface 246. In the illustrated embodiment, the concave bearing surface 246 follows the radius emanating from the pivot axis 74 when the valve member 26 is received in the operative position in the cap 22. In the illustrated embodiment, when the flexible sealing ring 236 is not in contact with the concave bearing surface 246, an outer convex surface 248 surrounds the upper drink opening 234. As seen in FIG. 6, the flexible sealing ring 236 and the outer convex surface 248, which is no longer convex, are biased towards a concave configuration when in contact with the convex outer surface 156 of the spout 24 to provide adequate sealing. Additionally, the outer convex surface 248 of the flexible sealing ring 236 deforms toward a concave configuration when in contact with the convex outer surface 156 of the spout 24 and a lowermost edge 252 of the flexible sealing ring 236 is spaced from the shoulder 228 when the flexible sealing ring 236 is in the concave configuration. As such, the flexible sealing ring 236 provides a self-adjusting seal that is under light pressure that is capable of conforming to the shape of the convex outer surface 156 of the spout, which allows for some misalignment of the convex outer surface 156 with respect to the concave bearing surface 246 of the valve member 26. As such, the likelihood of leaks in the straw lid valve assembly 20 is mitigated. While the figures depict the outer convex surface 248 surrounds the upper drink opening 234, the flexible sealing ring 236 may work as well where its outer surface follows the contour of the concave bearing surface 246. In this configuration, it is still desirable to have the lowermost edge 252 of the flexible sealing ring 236 spaced from the shoulder 228 when the flexible sealing ring 236 is in the concave configuration similar to that shown in FIG. 6.

The valve member 26 includes a downward flange 260 depending downwardly from the lower surface 214. A recess 262 is provided in the downward flange 260, which allows a user to grip the downward flange 260 when removing the valve member 26 from the cap 22. The valve member 26 further includes a lower outer flange 264 that defines an outer recess 266 that cooperates with the bottom cap 34 when the valve member 26 is received in the cap 22 in the operative position.

The valve member 26 is receivable in and removable from the cap 22, which facilitates cleaning. Also, the spout 24 is removable from the cap 22, which also facilitates cleaning. Moreover, the valve member 26 includes the drink passage 224, 226 and the vent passage 216 both of which are in fluid communication with the drinking vessel 28 through the straw 240 when the cap 22 is connected with the drinking vessel 28 and the valve member 26 is received in an operative position in the cap 22. The valve member 26 is receivable in the valve receiving passage 38 such that the uppermost surface 212 of the valve member 26 is exposed to ambient when the spout 24 is in the drinking position and the valve member 26 is received in the operative position in the cap 22. In many traditional straw valve assemblies, the vent opening in provided in a more rigid cap.

A straw lid valve assembly has been described above in particularity. Modifications and alterations will occur to those upon reading and understanding the preceding detailed description. The invention, however, is not limited to only the embodiments described above. Instead, the invention is broadly defined by the appended claims and the equivalents thereof. It will be appreciated that various features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A straw lid valve assembly comprising:

a cap configured to connect with a drinking vessel, the cap including a lower wall including a valve receiving opening that defines a portion of a valve receiving passage and a spout receiving recess having a recess floor, wherein the valve receiving passage extends from the lower wall to the recess floor;

a spout pivotally connected with the cap and pivotal about a pivot axis between a drinking position and a closed position, the spout including an inner passage that is in fluid communication with the drinking vessel when in the drinking position and is closed off from the drinking vessel when in the closed position; and a valve member receivable in the cap, and the valve member including a drink passage configured to receive a straw and a vent passage both of which are in fluid communication with the drinking vessel when the cap is connected with the drinking vessel and the valve member is received in an operative position in the cap, wherein the valve member is receivable through the valve receiving opening and in the valve receiving passage such that an uppermost surface of the valve member is exposed to ambient when the spout is in the drinking position and the valve member is received in the operative position in the cap.

2. The straw lid valve assembly of claim 1, wherein the valve member is an integrally formed piece of resilient material that fills the valve receiving passage and seals against an inner side of the valve receiving passage when the valve member is received in the operative position in the cap.

3. The straw lid valve assembly of claim 1, wherein the drink passage includes a shoulder between a lower passage and an upper passage, which has a smaller diameter than the lower passage, wherein the lower passage is configured to receive an associated straw within the lower passage.

4. The straw lid valve assembly of claim 3, wherein the valve member includes a flexible sealing ring surrounding an upper drink opening of the drink passage, wherein the flexible sealing ring deforms from a convex configuration toward a concave configuration when the spout is in the drinking position and a lowermost edge of the sealing ring is spaced from the shoulder when the flexible sealing ring is in the concave configuration.

5. The straw lid valve assembly of claim 1, wherein the valve member includes a flexible sealing ring surrounding an upper drink opening of the drink passage, wherein the flexible sealing ring is a self-adjusting seal capable of conforming from a convex configuration to a convex outer surface of the spout.

6. A straw lid valve assembly comprising:

a cap configured to connect with a drinking vessel, the cap including a valve receiving passage;

a spout pivotally connected with the cap and pivotal about a pivot axis between a drinking position and a closed position, the spout including an inner passage that is in fluid communication with the drinking vessel when in the drinking position and is closed off from the drinking vessel when in the closed position; and a valve member receivable in the cap, and the valve member including a drink passage and a vent passage both of which are in fluid communication with the drinking vessel when the cap is connected with the drinking vessel and the valve member is received in an operative position in the cap, wherein the valve member is receivable in the valve receiving passage such that an uppermost surface of the valve member is exposed to ambient when the spout is in the drinking position and the valve member is received in the operative position in the cap, wherein the valve member includes a flexible sealing ring surrounding an upper drink opening of the drink passage, wherein the flexible sealing ring is a self-adjusting seal capable of conforming to a convex outer surface of the spout, wherein the flexible sealing ring includes an outer convex surface when not in contact with the convex outer surface of the spout, and the outer convex surface of the flexible sealing ring deforms toward a concave configuration when in contact with the convex outer surface of the spout.

7. The straw lid valve assembly of claim 6, wherein the spout includes a convex outer surface and the valve member includes a concave bearing surface against which the convex outer surface bears when the valve member is received in the operative position in the cap.

8. The straw lid valve assembly of claim 7, wherein the valve member includes an upper vent opening of the vent passage disposed within the uppermost surface and an upper drink opening of the drink passage disposed within the concave bearing surface.

9. The straw lid valve assembly of claim 8, wherein the spout includes a vent closure that closes the vent opening when the spout is in the closed position.

10. The straw lid valve assembly of claim 9, wherein the vent closure is a bump extending from the spout.

11. A straw lid valve assembly comprising:

a cap configured to connect with a drinking vessel, the cap including a valve receiving passage;

a spout pivotally connected with the cap and pivotal about a pivot axis between a drinking position and a closed position, the spout including an inner passage that is in fluid communication with the drinking vessel when in the drinking position and is closed off from the drinking vessel when in the closed position; and a valve member receivable in the cap, and the valve member including a drink passage and a vent passage both of which are in fluid communication with the drinking vessel when the cap is connected with the drinking vessel and the valve member is received in an operative position in the cap, wherein the valve member is receivable in the valve receiving passage such that an uppermost surface of the valve member is exposed to ambient when the spout is in the drinking position and the valve member is received in the operative position in the cap, wherein the spout and the cap include cooperating axle features to pivotally connect the spout with the cap, the axle features including an axle and a circular recess that receives the axle, and one of the spout and the cap includes a channel emanating from the circular recess, wherein the axle is receivable in the channel to allow for selective removal of the spout from the cap, wherein when the spout is in the drinking position the channel being oriented such that removal of the spout from the cap is precluded when pulling the spout away from the cap in a direction aligned with the length of the channel, wherein when the spout is in the closed position the channel being oriented such pulling the spout away from the cap in a direction aligned with the length of the channel results in removal of the spout from the cap.

12. The straw lid valve assembly of claim 11, wherein the spout is provided with the circular recess and the channel, and the cap is provided with the axle.

13. A straw lid valve assembly comprising:

a cap configured to connect with a drinking vessel, the cap including a valve receiving passage;

a spout pivotally connected with the cap and pivotal about a pivot axis between a drinking position and a closed position, the spout including an inner passage that is in fluid communication with the drinking vessel when in the drinking position and is closed off from the drinking vessel when in the closed position, the spout includes a base including a convex outer surface and an extension extending from the base, wherein the inner passage extends through the base and the extension;

a valve member receivable in the cap, the valve member including a drink passage and a vent passage both of which are in fluid communication with the drinking vessel when the cap is connected with the drinking vessel and the valve member is received in an operative position in the cap, wherein the vent passage extends to an upper vent opening provided in an uppermost surface of the valve member, wherein the valve member is receivable in the valve receiving passage such that when the valve member is received in the operative position in the cap the uppermost surface of the valve member is exposed to ambient when the spout is in the drinking position and the extension covers the vent opening in the uppermost surface when the spout is in the closed position; and a straw received in the drink passage, wherein the valve member includes a flexible sealing ring surrounding an upper drink opening of the drink passage, and the flexible sealing ring is offset axially above a top end of the straw when the straw is inserted in the drink passage.

14. The straw lid valve assembly of claim 13, wherein the cap includes a lower wall including a valve receiving opening that defines a portion of the valve receiving passage and a spout receiving recess having a recess floor, wherein the valve receiving passage extends from the lower wall to the recess floor, and the valve member is receivable through the valve receiving opening and in the valve receiving passage.

15. The straw lid valve assembly of claim 13, wherein the flexible sealing ring is a self-adjusting seal capable of conforming from a convex configuration to a convex outer surface of the spout.

* * * * *